US005235822A

United States Patent [19]

Leonovich, Jr.

[11] Patent Number: 5,235,822

[45] Date of Patent: Aug. 17, 1993

[54] COMBINED PORTABLE COOLER WITH AUDIO SYSTEM

[76] Inventor: George A. Leonovich, Jr., 270 Communications Way, Hyannis, Mass. 02601

[21] Appl. No.: 907,167

[22] Filed: Jul. 1, 1992

Related U.S. Application Data

[63] Continuation-in-part of Ser. No. 536,491, Jun. 12, 1990, Pat. No. Des. 327,607, which is a continuation-in-part of Ser. No. 427,196, Oct. 26, 1989, Pat. No. 4,939,912.

[51] Int. Cl.[5] ..... F25D 3/08

[52] U.S. Cl. ..... 62/457.7; 206/542; 455/344; 312/237; 62/371

[58] Field of Search ..... 62/457.1, 457.2, 457.7, 62/371; 455/344, 351; 312/7.1, 237, 245, 214, 246; 206/216, 542

[56] References Cited

U.S. PATENT DOCUMENTS 3,836,221 9/1974 Whistler, Jr. et al. ..... 206/542

4,571,740 2/1986 Kirby et al. ..... 62/457.1

*Primary Examiner*—John Sollecito

*Attorney, Agent, or Firm*—Thomas A. Kahrl

[57] ABSTRACT

The present invention provides a portable food and beverage cooler in combination with an audio system, preferably a stereo an AM/FM radio receiver mounted in a recessed cavity on a wall of the cooler. The cooler has an outer shell, a recessed cavity having a sleeve extending around the edge of the cavity, an intermediate insulation layer, an inner shell, a partially removable top with handle for carrying the cooler with and an inner compartment enclosed by four adjoining walls for holding food and beverages. The audio receiver includes a plurality of components including the AM/FM receiver, or optionally an AM/FM cassette deck or Compact Disc player unit, one or more speakers, a power source battery, receptacle for a jack for earphones, separately mounted in a recessed compartment provided in one or more of the cooler walls , connected by a wiring circuit. Protective screens and waterproof sealing means are provided for keeping sand and moisture out of the speakers to improve quality of sound. Insulation of cooler also insulate stereo system components from sand, heat and moisture.

7 Claims, 5 Drawing Sheets

COMBINED PORTABLE COOLER WITH AUDIO SYSTEM

REFERENCE TO PRIOR APPLICATIONS

This application is a continuation-in-part of U.S. Pat. No. Design application Ser. No. 07/536,491, filed Jun. 25, 1991, now U.S. Pat. No. D327,607 which in turn is a continuation-in-part of U.S. patent application Ser. No. 07/427,196, filed Oct. 26, 1989 , now U.S. Pat. No. 4,939,912, which are incorporated herein by reference.

BACKGROUND OF THE INVENTION

The present invention relates to providing a light-weight portable cooler for food and beverages including a portable audio receiver, and to providing a portable cooler with stereo receiver system.

Carrying food and beverage containers and other articles such as a portable AM/FM radio or audio or Tape Cassette recorder by hand to the location of a picnic or a beach or other outdoor activity, often remote from access by vehicle, is frequently cumbersome and tiring. Portable coolers are generally available which are light-weight and convenient and portable AM/FM radios or tape cassette recorders are available which are compact and light-weight. Nevertheless, it is difficult to carry such audio receiver units in addition to other picnic articles, particularly to the beach, and in addition small portable AM/FM radios or tape cassette or compact disc players are susceptible to malfunction due to the action of sand and moisture, especially salt water.

In my U.S. Pat. No. 4,939,912, filed Oct. 26, 1989, there is disclosed a cooler having a void between an outer shell and inner shell for containing a receiver being sealably surrounded in insulating material.

It is therefore desirable to provide a lightweight portable cooler which incorporates an audio system including a receiver and one or more speakers adapted to operate on a portable power source, and to overcome at least some of the disadvantages of the prior art coolers.

SUMMARY OF THE INVENTION

The present invention is directed to an improved portable cooler and audio apparatus and to a combined portable cooler and stereo system. In particular, the invention provides for a lightweight, portable, cooler having insulated walls which incorporates cutouts in the walls for audio apparatus comprising an AM/FM radio including a portable power source, receiver and one or more speakers, which cutouts protect the components from sand and moisture, wherein the speakers are in spaced relationship for improved audio quality of sound which are protected from moisture and contamination from sand.

In the preferred embodiment of the present invention the cooler is of portable construction having insulated walls, typically with four adjoining walls, with a first wall characterized by a plurality of cut-outs adapted to receive components of a portable AM/FM radio system sealably positioned in spaced relationships in the first wall of the cooler. The cooler is of conventional injection molded plastic and foam construction, and can be of variable size, though in the preferred embodiment said cooler is of a size sufficient to hold up to six beverage containers as well as a conventional coolant packet.

The cooler of the preferred embodiment includes container having a main compartment of generally rectangular shape enclosed closed by four walls, integrally connected to a base to provide a space for items, a partially removable hinged top with handle, having hinge means and a latch means for providing access to the cooler's main compartment The cooler handle, for use in carrying the cooler, is formed integrally with the top and is provided with socket means for mounting a conventional retractable antenna.

The container of the preferred embodiment has a resilient outer shell formed from a sheet of plastic material, a resilient inner shell, also formed from a sheet of plastic, an intermediate void filled with liquid-filled foam insulation disposed between said outer and inner shell.

In the preferred embodiment a plurality of cut-outs are provided, the first wall includes a receiver cut-out and a plurality of speaker cut-outs and a power source cut-out compartment. A receiver, typically an AM/FM receiver, is mounted in the receiver cut-out and is connected by electrical wire means to a plurality of speakers, typically stereo speakers, preferably two, mounted in the speaker cut-outs, being disposed on opposite sides of the receiver in the front wall, each being connected by wiring means to a power source, preferably a 9 volt DC battery. An antenna is provided, preferably retractably mounted on a socket and in the preferred embodiment, adapted to be received in a groove in the top of the handle disposed in parallel relationship with the top of the handle when not in use. A battery compartment is provided in a wall, typically the first wall of the cooler to include a 9 volt battery for attachment with battery clip means connected by wiring to the receiver.

The cooler being of molded construction, with an intermediate layer of foam insulation material wherein the outer shell includes insulated openings for fastening audio components including a radio receiver, speakers, battery and earphone jack, typically by screw fasteners. During construction of the cooler, the inner shell is connected to the outer shell having the radio receiver and speakers affixed thereto, and the battery compartment extending inwardly in the intermediate void and each interconnected by insulated electrical wiring means. Foam insulating material while in a liquid state is pumped into the void through an opening in the base of the compartment sealing the receiver and speakers. The speakers are protected from sand and other contaminants, including water, by disc shaped screens having a fine wire mesh mounted on the front of the speakers. Both the speaker and the radio receiver are protected by washer and gasket means provided on the mounting surfaces of the respective compartments.

Another embodiment of the invention includes a tape cassette deck, in lieu of the radio receiver. In yet another embodiment a solar power unit is incorporated in lieu of a 9 volt battery. In a further embodiment, the stereo apparatus comprises a compact disc player.

In a further embodiment of the invention, cooler is of molded construction, of plastic insulation material, typically foam filled wherein one wall of the cooler includes a recessed cavity extending partially into one of the walls for attaching the audio apparatus, typically including a receiver, speakers, and portable power source. The recessed cavity comprises a back panel integral with the cooler side wall, and a sleeve characterized by a generally rectangular opening having two side frame members and a top frame member and a bottom frame member. In this embodiment preferably the front wall of the insulated cooler includes the recessed cavity which is of unitary construction for receiving a stereo not encapsulated in a housing adapted to fit into the sleeve, said audio apparatus including a receiver, at least one speaker and a power source . Typically the receiver is an AM/FM radio receiver and is connected by electrical wire means to the speaker unit, typically having two stereo speakers being disposed on opposite ends of the housing, each being connected by wiring means to a power source, preferably a 9 volt DC battery, mounted in the housing.

In this embodiment the insulated cooler may be formed by injection molding with the two side walls, and two end walls each having a uniform cross-section of insulating material, and the housing of the stereo unit is of generally rectangular construction and is adapted to be attached to frame members installed on the outer peripheral edge of the unitary cutout in the front wall of the cooler, having a thickness of no less than 1" and no more than 2½".

The invention will be described for purposes of illustration only in connection with certain embodiments; however, it is recognized that those persons skilled in the art may make various changes, modifications, improvements and additions on the illustrated embodiments, all without departing from the spirit and scope of the invention.

BRIEF DESCRIPTION OF THE DRAWINGS

FIG. 12 is a front elevational view of the improved cooler of the invention of FIG. 8 with a compact disc player encapsulated in the housing;

DESCRIPTION OF THE EMBODIMENTS

Figure 1:
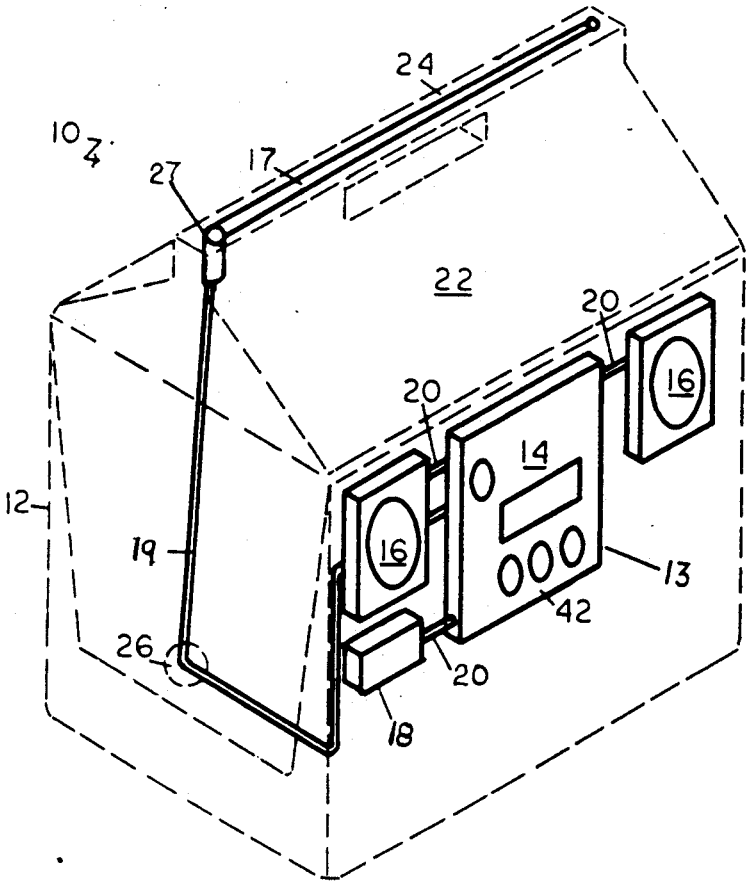
FIG. 1 is a perspective view of a combined cooler and audio system of my invention.
Figure 2:
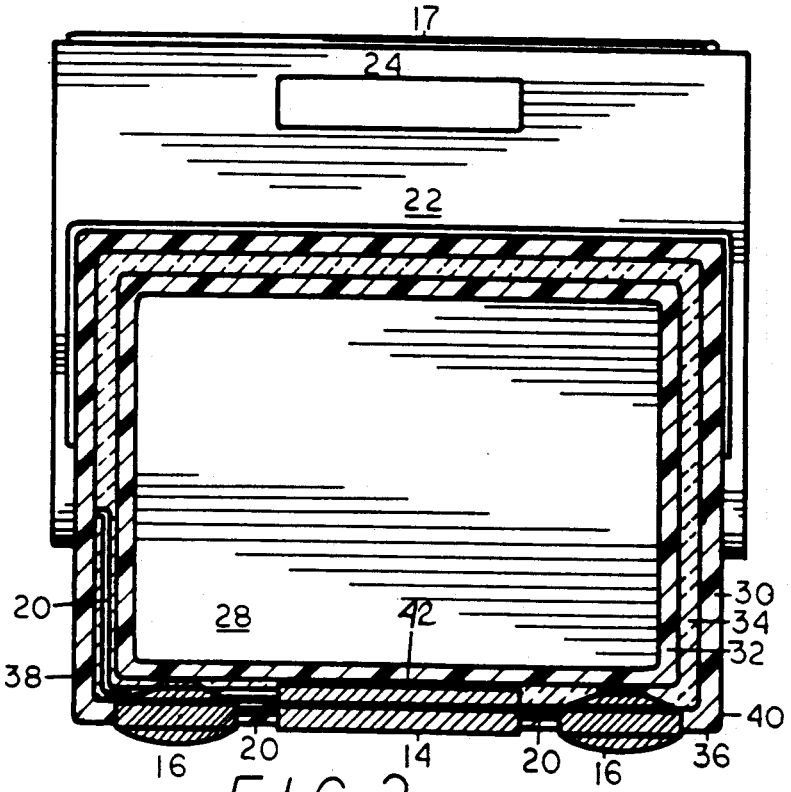
FIG. 2 is a top elevational, partially sectional view of thereof.
Figure 3:
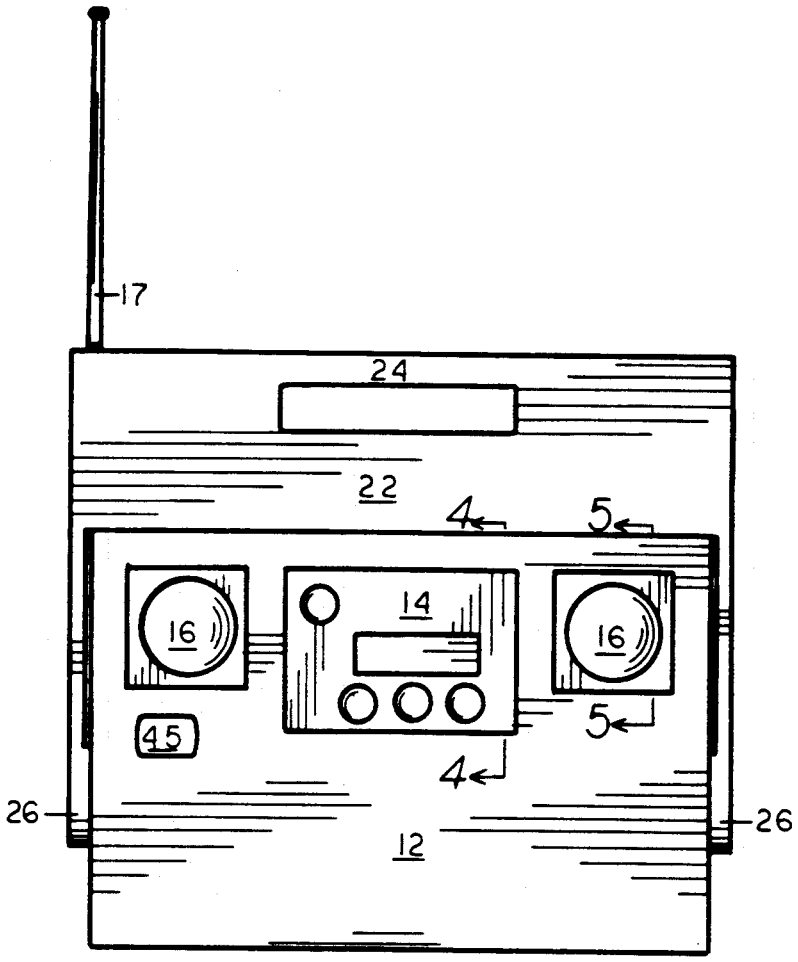
FIG. 3 is a front elevational view thereof.

With reference to the drawings, FIG. 1 shows a first embodiment of a combination portable cooler with audio system 10, including a cooler 12 and a radio circuit 13 mounted integrally on the cooler 12. The radio circuit 13 comprises a conventional radio receiver 14 a plurality of conventional speakers 16, consisting of a first and second speaker, a power source 18, consisting of a 9 volt dc battery in the preferred embodiment, a retractable antenna 17 with antenna cable 19 and wire means 20 for electrically connecting the power source 18 to the receiver 14 and to the speakers 16. With reference to FIGS. 1 and 2, the cooler 12 includes a partially removable top 22 With integral handle 24, and a hinge means 26 connecting the top 22 to an insulated container 28 in a manner permitting the top 22 to be rotably moved through of an arc of approximately 90 degrees, either to the front or to the rear of the container 28 from a closed position to an open position, and a socket 27 adapted to receive one end of the antenna 17 for mounting. As connected to the socket 27, and as shown in FIGS. 1 and 3, the antenna 19, which normally rests in a groove provided in the handle 24 disposed in parallel relationship therewith and intermediately adjacent thereto, being movably mounted at one end in socket 27, may be raised to an upright position in perpendicular relationship with the handle for receiving transmitted radio signals. Antenna cable 19 is connected to socket 27 and extends downwardly along one side of the handle 24 and continues along one side of the top 22 to the hinge means 26 thence running to the receiver 14.

Figure 4:
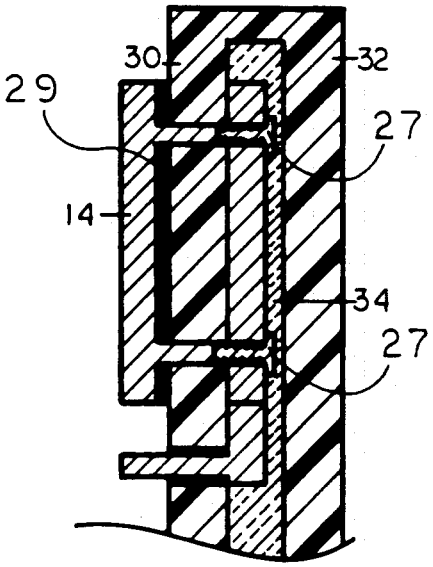
FIG. 4 is a sectional view along lines 4—4 of FIG. 3 showing an AM/FM receiver mounted in a wall of the cooler.
Figure 5:
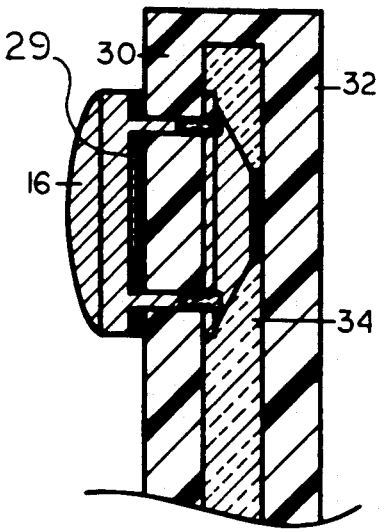
FIG. 5 is a sectional view along lines 5—5 of FIG. 3 showing a speaker mounted in the wall of the cooler.

As shown in FIG. 2, cooler 12 includes an insulated container 28 of generally rectangular shape and of sandwich construction having an outer shell 30 of generally rectangular construction constructed of a sheet of resilient molded plastic, an inner shell 32 also of generally rectangular construction, constructed of a sheet of resilient molded plastic spaced inwardly of and connected to outer shell 30 by lip member 31 thereby creating an intermediate void 33 as shown in FIGS. 4 and 5. As shown in FIG. 2, cooler 12 includes an insulated container 28, an intermediate layer of foam insulation 34 disposed between the inner shell 32 and the outer shell 30, four adjoining walls, including a first wall 36 and a second wall 38 integrally connected to a base 41 defining a space for storing items being kept cool. The insulation 34 has a composition adapted to permit pumping of the insulating material into the void 33 to fill it and to sealably encase the radio circuit 13 components and wire means 20 during construction of the container 28.

As shown in FIGS. 1 and 2, the radio circuit 13 incorporated in the construction of the cooler 12 includes an AM/FM radio receiver 14, securely positioned in the central portion of first wall 36, the first and second speakers 16, securely positioned on either side of the radio receiver 14 on the first wall 36, and the power source Is, preferably 9 volt dc current battery is clipped into battery compartment 44 provided adjacent to an intermediately below the first speaker in the first wall. Wire means 20, preferably being rubber coated for waterproof protection connect the radio components including the battery and are disposed in the void with foam insulation inserted to sealably enclose the wire means 20.

As shown in FIGS. 4 and 5, the audio system 10 including the AM/FM receiver 14, the speakers 16 and the battery 18 are securely mounted in the first wall-by screw means extending from mounting plate means disposed in void with the screw means extending outwardly through a plurality of cutouts provided in the outer shell 30. Said receiver 14 is securely attached to the outer shell 30 portion of the first wall by screw means 27 with gasket means 29 being provided to keep out moisture. The speakers 16 are provided with screw means 27 and gasket means 29 to keep out contamination such as sand and water.

Figure 6:
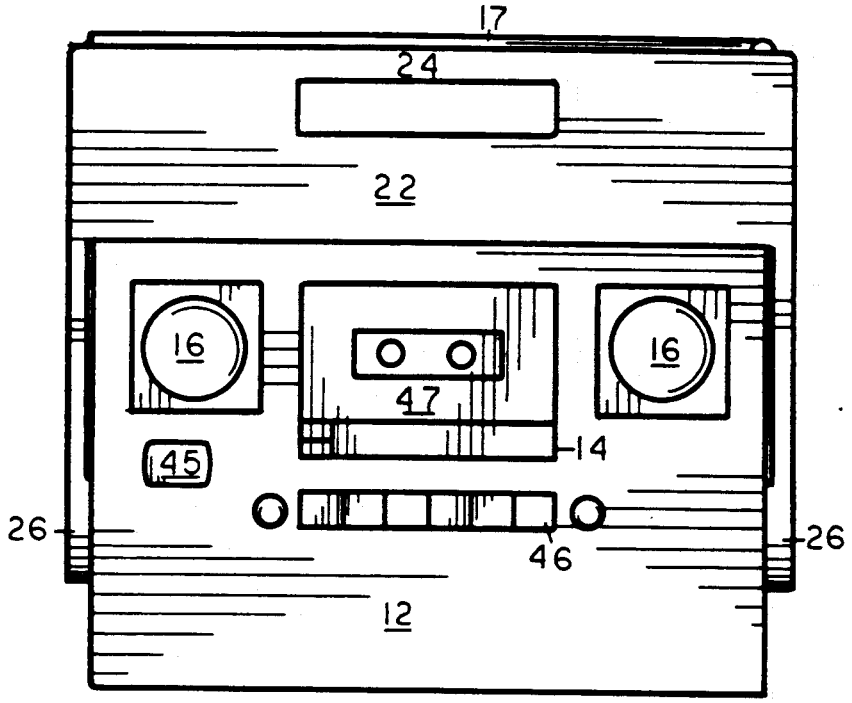
FIG. 6 is a front elevational view of a second embodiment of the combination cooler and stereo system with a tape cassette.

As illustrated more particularly in FIG. 6, another embodiment of the invention includes an audio system 10 comprised of a cassette deck 47 for playing tapes, mounted on the first wall with cassette controls 46 provided adjacently below. Alternatively, the audio system 10 may comprise a Compact Disc Player Unit 71.

Figure 7:
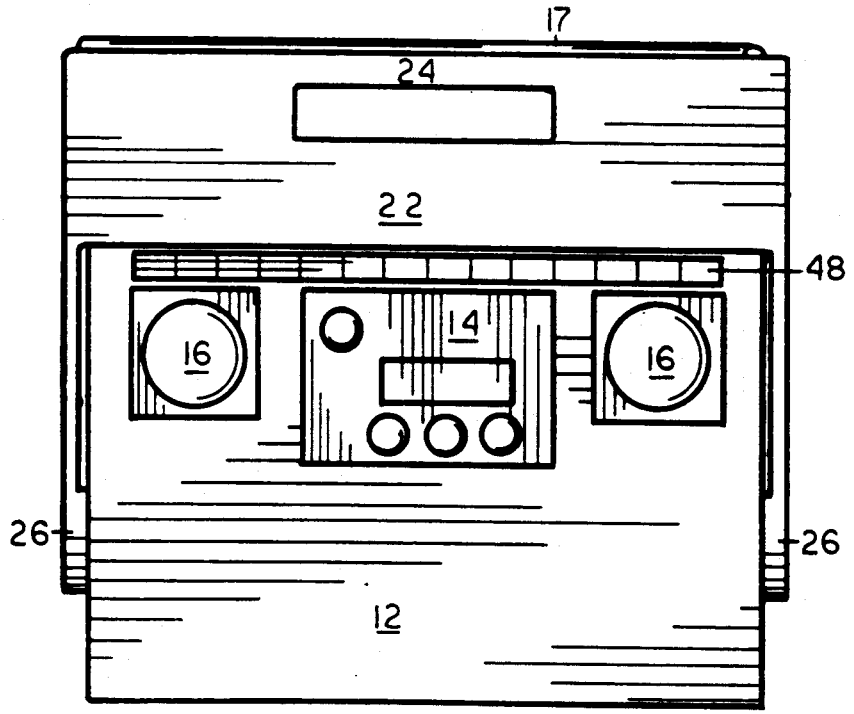
FIG. 7 is a front elevational view of a third embodiment of the combination cooler with radio and solar power cell.
Figure 8:
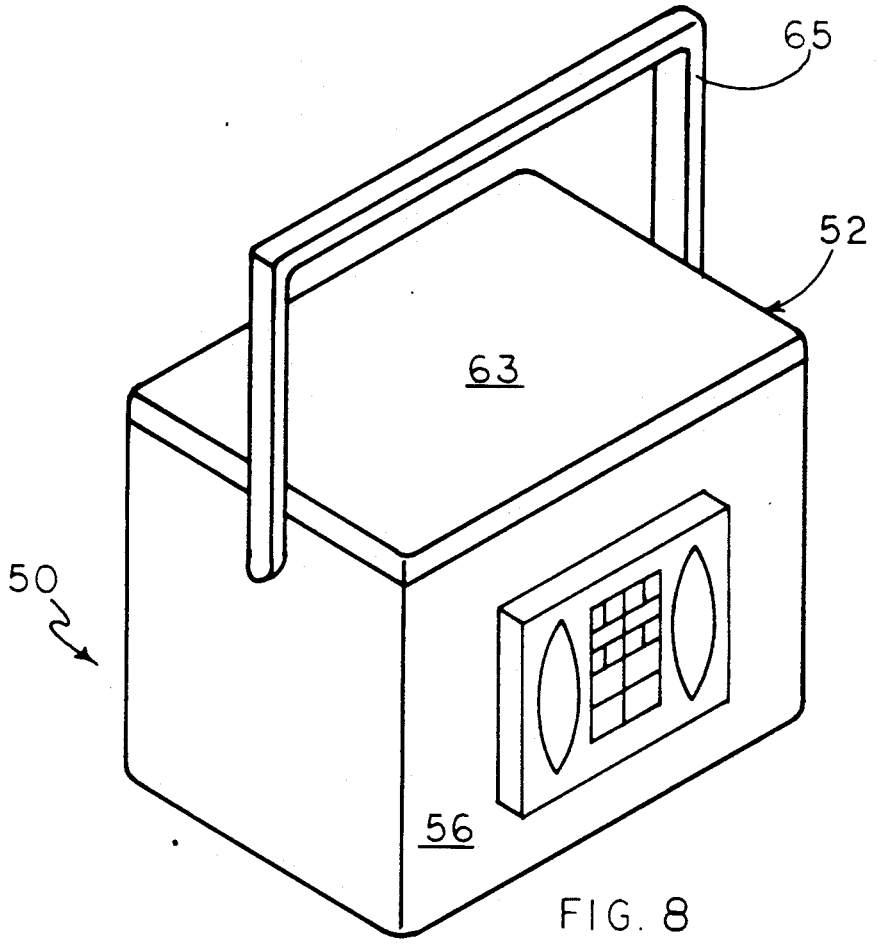
FIG. 8 is a perspective view of an alternate embodiment of the combined cooler and stereo system of my invention showing the employment of a recessed cavity and stereo receiver and speaker unit contained in a unitary housing.

As illustrated more particularly in FIG. 7, another embodiment of the invention includes a solar power unit 48 mounted on the first wall 36.

As further shown in FIGS. 8 through 11 an alternate embodiment of the invention comprises a combination portable cooler and stereo 50, comprising a cooler 52 and an audio unit 58. The cooler is shown having a recessed cavity 54 in a wall 56 of the cooler 52 for receiving the audio unit 58 enclosed in a housing 74 The cooler 52 is configured an insulated container for containing food and beverages as well as a refrigerant device not shown, having a pair of side enclosure walls 56 and a plurality of end walls 60 a top 63, an enclosure bottom 64, and a carrying handle 65 attached to said end walls each constructed of molded, plastic insulation material. The recessed cavity 54 is positioned in a selected enclosure wall, in the preferred embodiment shown in the side enclosure wall 56 for providing a recessed mount for the audio unit 58 encapsulated in housing 75, 58 said recessed cavity comprising a back wall 70 integral with side enclosure and a sleeve 72 extending around the peripheral edge of said cavity. Said sleeve is configured for receiving the housing 74 constructed to cooperate with the sleeve 72 with an interference fit to hold said housing in place in said recessed cavity. The housing 74 encloses the audio unit 58 50 comprising an audio receiver 76 and a plurality of speakers 78 connected by wiring means to a conventional battery power source. Said housing is constructed to encapsulate the audio receiver 76 and speakers 78 in a unitary water-proof structure.

Figure 9:
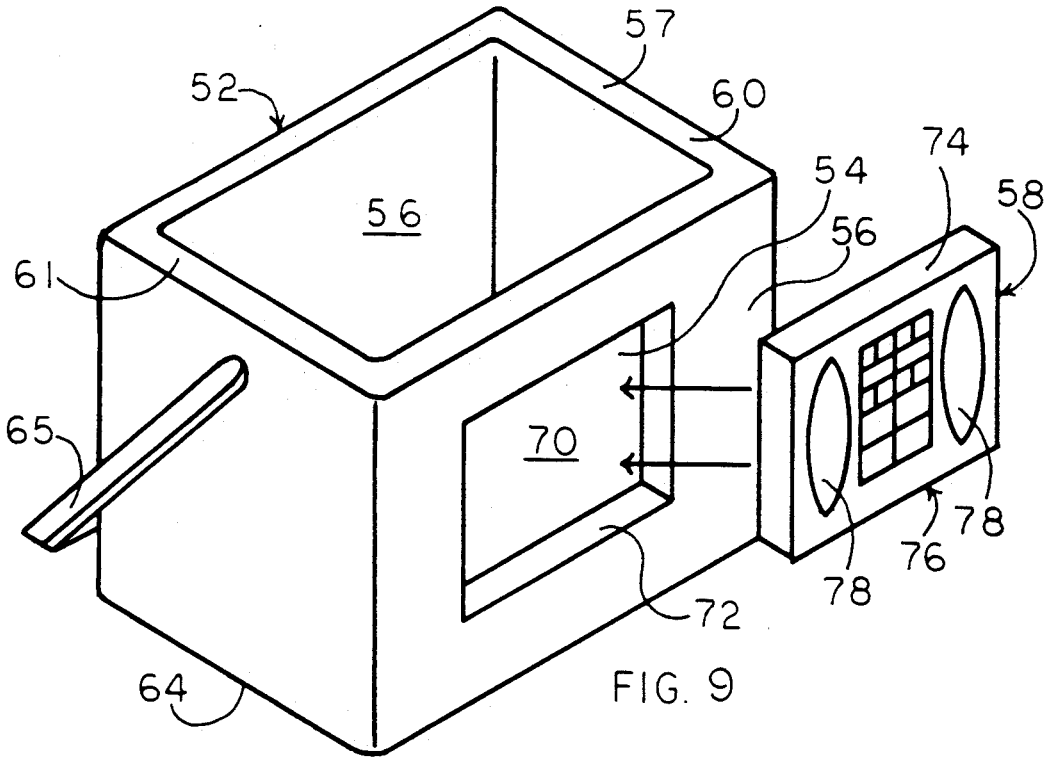
FIG. 9 is a top elevational, partially sectional view of the cooler of the invention as employed in FIG. 8.
Figure 10:
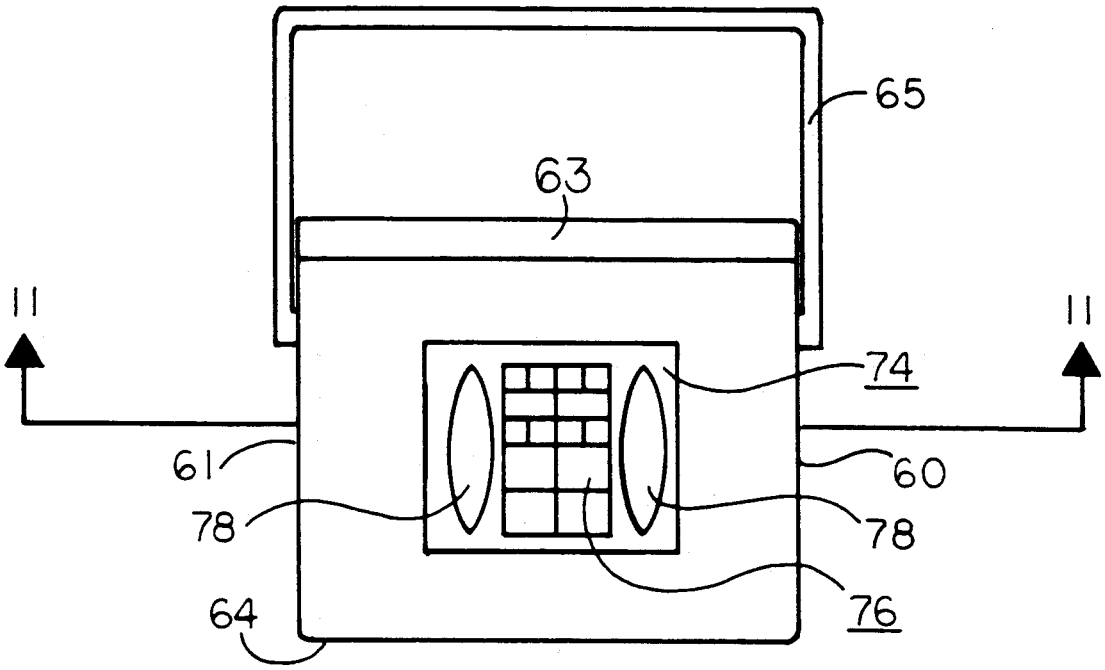
FIG. 10 is a front elevational view of the improved cooler of the invention of FIG. 8 with an audio apparatus encapsulated in a housing.
Figure 11:
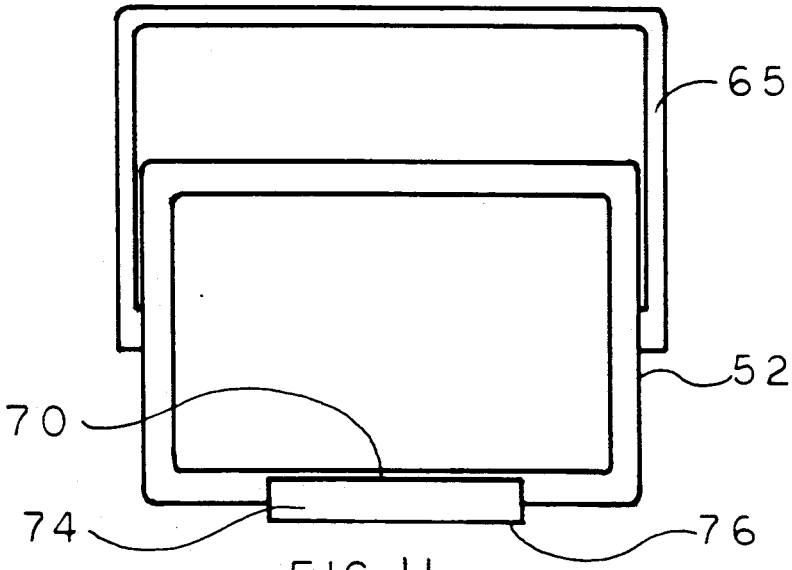
FIG. 11 is a sectional view along lines 11—11 of FIG. 10 showing the audio's apparatus mounted in the wall of the cooler.

As shown in FIG. 9, the recessed cavity 54 comprises a unitary cavity for receiving the audio unit 58 in the housing 74, wherein conventional electrical conductor is provided for connecting a conventional battery powered, power source with the receiver and for connecting the receiver to the speakers. A plurality of fasteners, typically screw fasteners 76 are provided for securing the housing 74 in place in the recessed cavity 54.

What is claimed is:

1. A portable cooler and stereo apparatus comprising in combination;

a) an insulated enclosure means for providing a storage compartment for containing foodstuffs and beverages comprising a portable cooler constructed of insulating material, said cooler comprising a plurality of enclosure walls a carrying handle attached to said walls, an enclosure bottom and a removable top;

b) a stereo apparatus having components comprising a receiver, one or more speakers, a portable power source, an antenna device and electrical circuit means for electrically connecting said components;

c) recessed cavity means positioned in at least one of the enclosure walls for attaching the stereo apparatus to the insulated enclosure means comprising a recessed cavity, and a sleeve characterized by a generally rectangular opening having side frame members and top and bottom frame members extending around the periphery of the recessed cavity; and d) a housing means for encapsulating the stereo apparatus comprising a unitary, waterproof housing comprising an outer peripheral rim for engaging the associated frame members of said recessed cavity with an interference fit; wherein sleeve extends around the peripheral edge of the recessed cavity for receiving the outer edge of the housing means for removably attaching the stereo apparatus to the enclosure wall of the portable cooler.

2. The portable cooler and stereo apparatus of claim 1 wherein the stereo apparatus is sealable enclosed in the housing means adapted for selective removable attachment to the portable cooler by pressing the housing means into the recessed cavity means in a selected enclosure wall of the portable cooler.

3. The portable cooler and stereo apparatus of claim 1 wherein the recessed cavity means comprises a unitary recessed cavity for receiving the housing means containing an audio receiver and at least one speaker having a back wall extending partially in to a selected enclosure wall and integral with said enclosure wall of the portable cooler.

4. The portable cooler of claim 1 wherein the insulating enclosure means contains a removable top and a handle for carrying the portable cooler.

5. The invention claimed in claim 1 wherein the electrical circuit means includes electrical conductor for connecting a power source with the receiver and for connecting the receiver to the speakers.

6. The portable cooler of claim 1 wherein the stereo apparatus comprises a plurality of speakers.

7. The portable cooler of claim 1 wherein the stereo apparatus is a Compact Disk Player.

* * * * *